United States Patent [19]

Bishop

[11] 4,211,398

[45] Jul. 8, 1980

[54] FEEDERS FOR CARDBOARD AND LIKE BLANKS

[75] Inventor: Thomas D. Bishop, Birmingham, England

[73] Assignee: The Deritend Engineering Company, Birmingham, United Kingdom

[21] Appl. No.: 942,465

[22] Filed: Sep. 14, 1978

Related U.S. Application Data

[63] Continuation-in-part of Ser. No. 786,991, Apr. 13, 1977.

[30] Foreign Application Priority Data

Apr. 22, 1976 [GB] United Kingdom ..... 16297/76

[51] Int. Cl.[2] ..... B65H 3/08

[52] U.S. Cl. ..... 271/9; 271/12; 271/107

[58] Field of Search ..... 271/9, 4, 5, 6, 11–13, 271/106, 107

[56] References Cited

U.S. PATENT DOCUMENTS

| | | | |
|---|---|---|---|
| 3,378,251 | 4/1968 | Donabin | 271/9 |
| 3,830,489 | 8/1974 | Adams | 271/9 |

*Primary Examiner*—Richard A. Schacher
*Attorney, Agent, or Firm*—Marshall & Yeasting

[57] ABSTRACT

The invention provides a feeder having two stacks which are top fed by reciprocating suction boxes, the stacks feeding alternately and a belt being used to transfer blanks from the rear stack.

2 Claims, 6 Drawing Figures

FEEDERS FOR CARDBOARD AND LIKE BLANKS

CROSS-REFERENCE TO RELATED APPLICATION

This is a continuation-in-part of Ser. No. 786,991 filed Apr. 13, 1977.

SUMMARY OF THE INVENTION

This invention relates to feeders for cardboard and like blanks.

In accordance with the invention considered broadly, a feeder comprises a platform supporting a stack of blanks to be fed, means for raising the platform to maintain the top of the supported stack at about a predetermined height, a stationary head located above the platform and stack and provided with inlet openings connected to a negative pressure source for sucking a blank into contact with the head, and a reciprocating suction box provided in the head and having its surface substantially co-planar with the surface provided with the stationary inlet openings, for feeding the blanks onwards.

Preferably the arrangement is such that the suction, at least in the reciprocating box, is released whilst the box is travelling at a predetermined and constant speed as it approaches its most forward position and so that the leading edge of the fed blank is already received in a pair of feed rolls when the suction is released. The front end of the reciprocating suction box may be made thin, and one roller shaped to allow that end to feed the blank right through the nip. Suction may be reapplied when the box is returned to its rearwards position. Desirably the linear speed of the box is accelerated to the same linear speed as the feed rolls, the drive of the box being timed with subsequent apparatus in use, so as to synchronise the blank with any subsequent treatment rolls such as cutters, slotters, printers and the like.

The stationary suction inlets may be provided in groups located on either side of the reciprocating box, and moreover if so required, a plurality of coupled boxes may be provided, and additional stationary inlets between each two. The said stationary inlets are preferably provided primarily if not exclusively at the front of the head that is towards the feed rolls, so as to ensure that the blank is pulled flat at this zone to ensure good contact with the reciprocating feed box and to ensure good feeding into the feed roll nip.

In accordance with a feature of the invention, side and rear joggers are provided to align the lateral edge of the top blank or blanks of the stack relative to the machine and the joggers may comprise a finger or fingers which are spring urged to an outward position and moved laterally beyond that outward position once in each cycle.

Modern blank treatment apparatus works at a high rate, and when using thick board a complete stack will be fed through the apparatus in a short time.

According to a further and important feature of the invention we duplicate the feeder and arrange for the stacks to be used alternately, providing additional transferring means for displacing blanks onwardly one by one when the rear stack is in use. Hence when the front or forward stack is exhausted, the rear stack is brought into use, either automatically via a sensor device or manually, allowing the first stack to be replaced, and vice versa with the rear stack.

The transferring means for the rear stack comprises the head associated with the front stack. Additionally, feed belts may be provided for example lying in channels in the head on either side of the reciprocating box over the front stack, which may carry retractable gripping clamps arranged so as to engage with the leading edge of the blank being fed from the rear stack to pull (or push) that blank forwardly so as to carry it over any unavoidable space between the two heads. The arrangement would then provide for the grippers to retract, or be fed internally of the belt channels due to the movement of the endless belts, so as to offer no impediment to the picking up and forward feeding of that blank by the head over the front stack.

It will be appreciated that the grippers in this arrangement may re-emerge to engage a fresh blank being fed forwardly from the rear stack at the same time that the previous blank is being fed forwardly by the front head, both feed motions taking place simultaneously and continuously.

DESCRIPTION OF THE PREFERRED EMBODIMENTS

Figure 1:
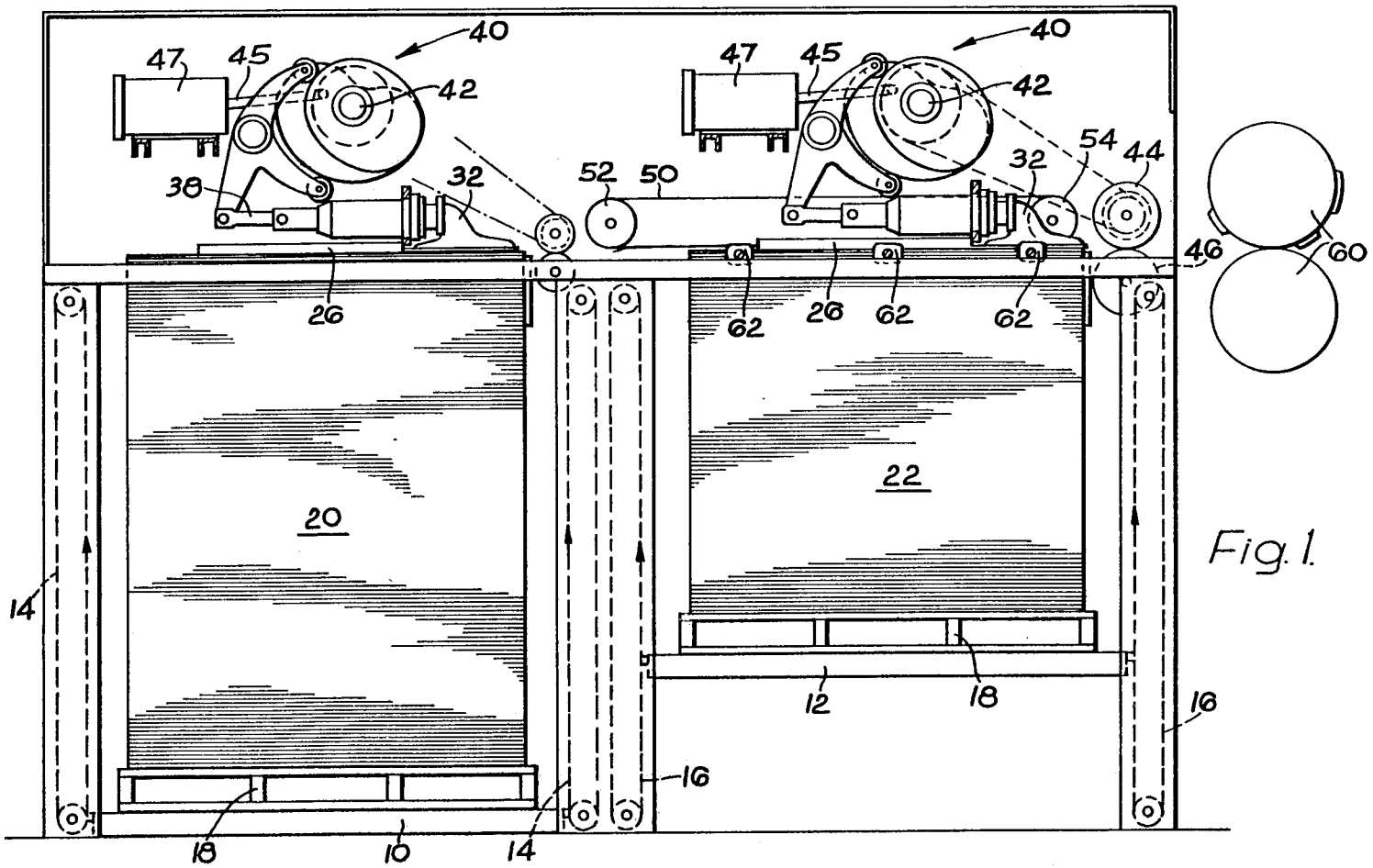
FIG. 1 is an elevation of a feeding apparatus.

Referring to the drawings, FIG. 1 shows a pair of platforms 10 12 each associated with elevation means comprising chains 14 14 16 16. Each platform is to support a corresponding pallet 18 which in turn supports a corresponding stack 20 22.

The apparatus comprises a main framework, only parts of which are shown.

Figure 3:
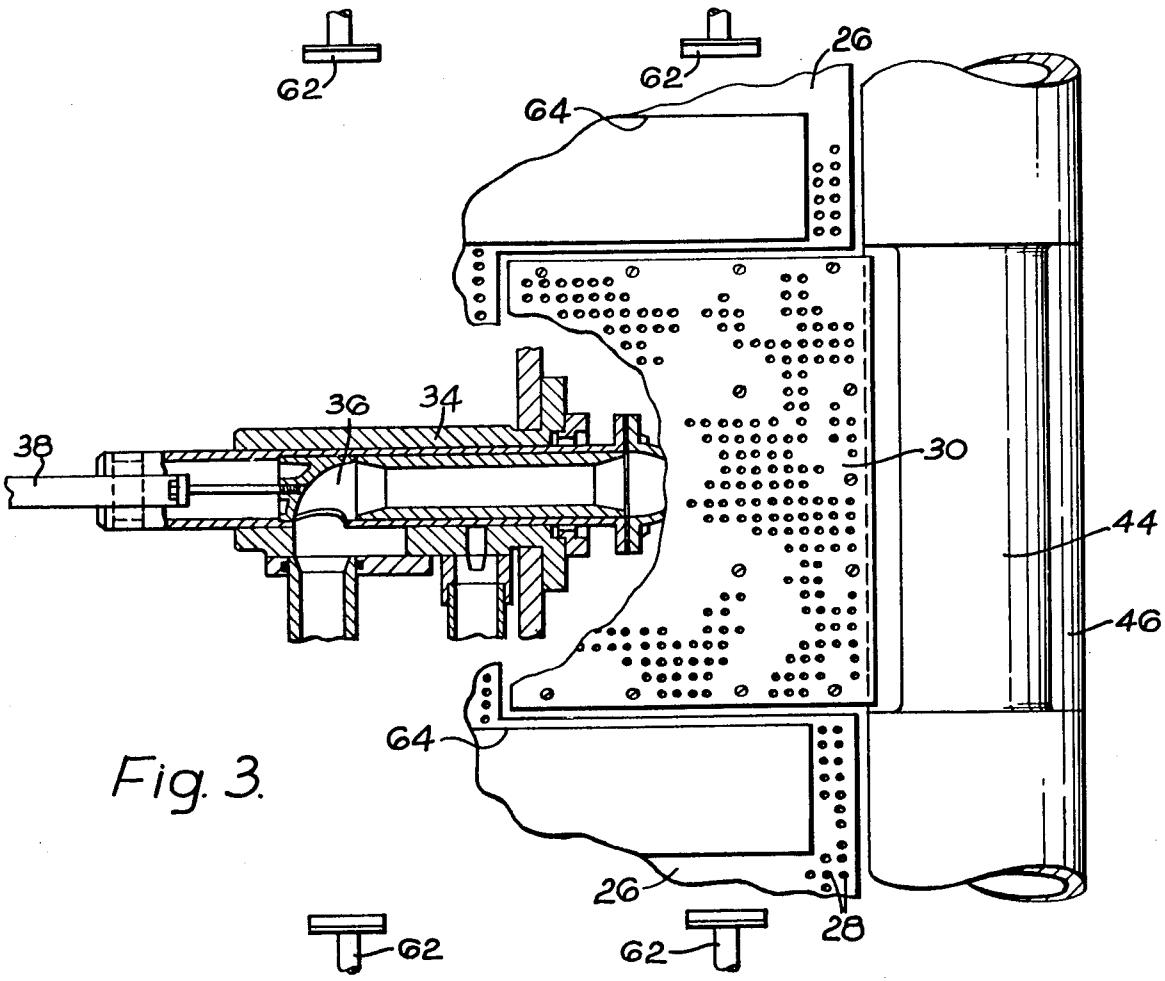
FIG. 3 is a fragmentary underneath plan view also partly in section.

Located above each of the stacks is a main plate 26 which as best seen in FIG. 3 is provided with a regular pattern of apertures such as 28 and the space above plate 26 forms an enclosed chamber which is connected to vacuum means for evacuating the chamber and hence drawing the uppermost blank of a stack into intimate contact with the plate over substantially the whole of the area of the plate.

Figure 2:
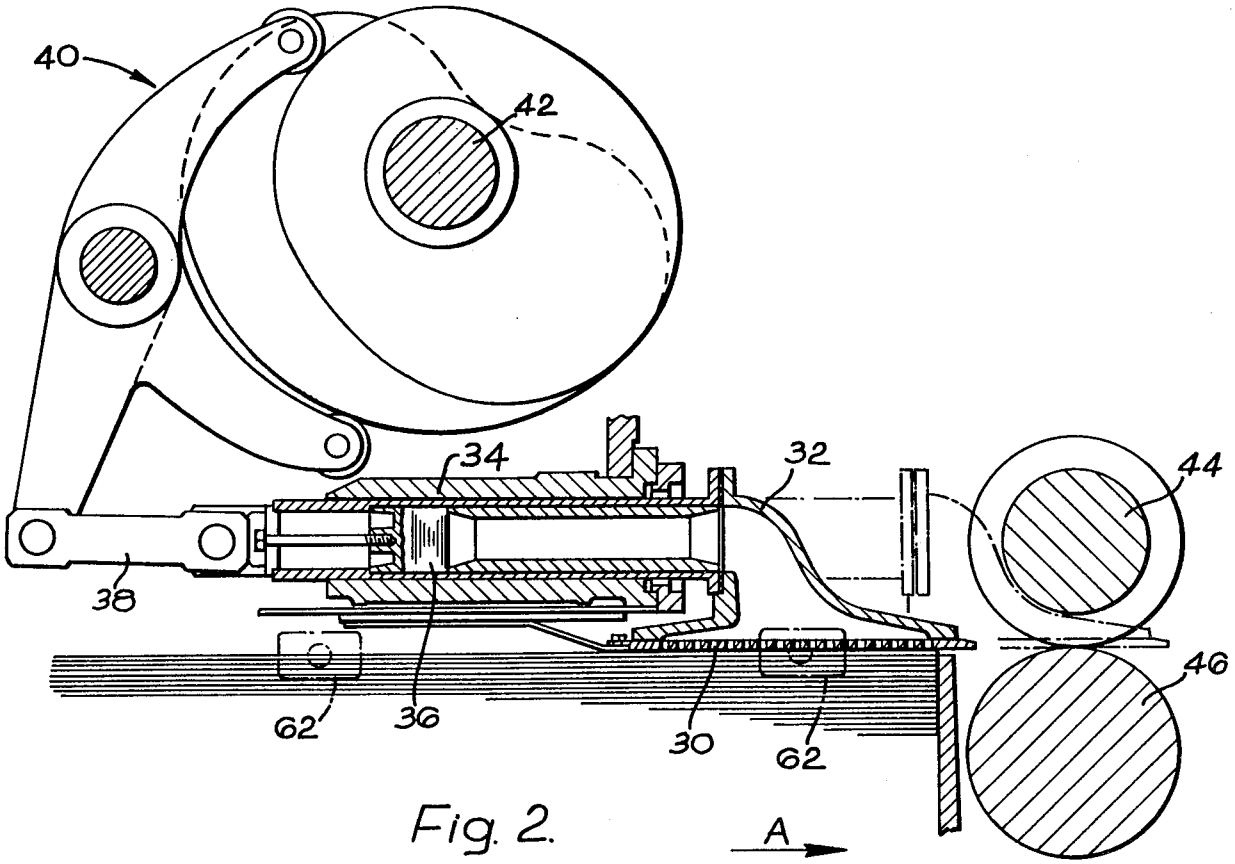
FIG. 2 is an enlarged scale part sectional and fragmentary view of the same.

The plate is provided with a centrally located gap opening to the leading edge of the plate (the leading edge being at the edge of the stack located towards the right hand side as seen in FIG. 1) and this gap locates a further apertured plate 30 which is also enclosed by further walls to form a chamber. The chamber including apertured plate 30 is indicated by the reference numeral 32 (see particularly FIG. 2), and the chamber is connected to a vacuum source via a valve piston and cylinder 34 36, which is connected via link 38 to a system of operating cams and cam followers generally indicated by the reference numeral 40. The cams are arranged to drive the whole of the piston and hence the manifold and plate 30 displaced to the right as shown in the drawings (and also return the same) thus feeding the blank with the plate 30 in the direction of the arrow A and hence taking the leading edge of the blank between the nip of the feed rolls 44 46. At the same time the cam driven movement causes displacement of the piston relative to the cylinder to open and close the chamber from communication with the vacuum source, at appropriate points in the cycle. The cams are driven by shafts 42. As best seen in FIG. 3, the upper feed roll 44 is waisted, and the chamber wall 32 has a tapering narrow leading portion so as to enter the waisted portion, thus enabling the leading edge of the blank to be delivered through the gap or nip between the rolls.

As illustrated, in FIG. 1, the shaft 42 is arranged to drive connecting rod 45 to a further piston and cylinder arrangement 47 (one for each set of apparatus) which provides the vacuum.

It will be appreciated that the apparatus thus far described is generally duplicated, with one set over each platform 10 12. The forward stack apparatus over platform 12 is associated with a drive belt 50 running around end rollers 52 54 and with the belt provided with a gripping mechanism so that when blanks are being fed from the stack over platform 10 they may be carried over platform 12 by the gripping mechanism. That is to say, assuming that the front stack 22 is being fed, this will continue until there is no blank left, whereupon the vacuum above the front plate 26 will be cut off e.g. by opening a main valve in the vacuum pipe (not shown), and at the same time rollers 52 54 will be driven to start feed of the belt 50. Blanks will then be fed from the stack 20 one by one. Whilst the stack 20 is being fed, stack 22 will be replenished, so that when the stack 20 has been used up, the stack 22 can be started. The lower run of each belt 50 lies in a channel 64 in the plate (see FIG. 3).

FIG. 1 shows diagrammatically a pair of treatment rolls 60 associated with the feed apparatus and for treating the fed blanks. The drawings also illustrate the position of the side joggers 62 provided for aligning the upper blanks of each stack prior to feeding.

Figure 4A:
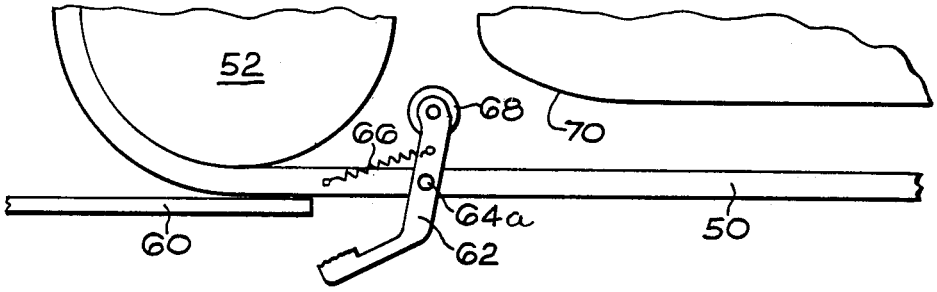
FIG. 4 is a detail view of a gripper.
Figure 4B:
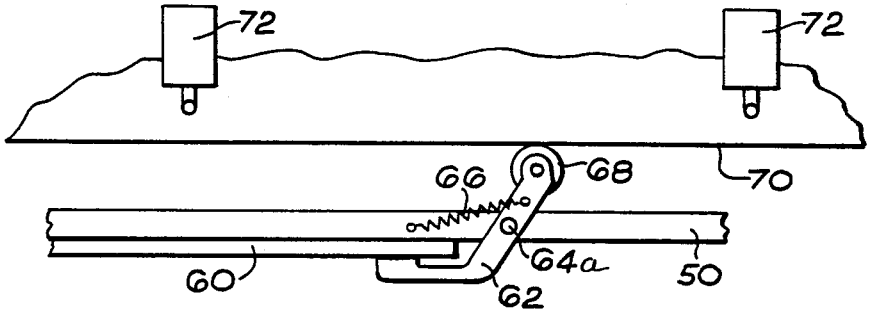
Figure 4C:
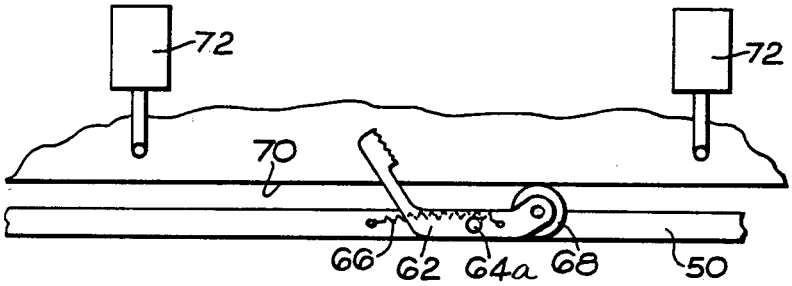

The gripping mechanisn on the belt 50 is shown in FIGS. 4*a,b* and *c* and comprises a finger 62 pivoted at 64*a* to the belt and biassed by spring 66 to an open position (FIG. 4*a*). The upper end of the finger 62 carries a roller 68 which is co-operable with a vertically adjustable cam track 70 (not shown in FIGS. 1 to 3) along the lower rim of the belt 50, the track 70 being arranged so that when in the position shown in FIG. 4*b* the roller 68 is displaced downwardly to bring the lower end into gripping engagement with the blank. The cam track 70 is displaceable downwardly when blanks are fed from the front stack from the position of FIG. 4*b* to that of FIG. 4*c*, for example by hydraulic rams indicated substantially at 72. In the latter position, the fingers are pivoted to a retracted position above the lower surface of the underside of belt 50. Instead of being provided on the belt 50, the gripper mechanism may be provided on a chain extending alongside the belt.

I claim:

1. A pair of feeders arranged in line and adapted to the use alternately, each feeder comprising (a) a platform supporting a stack of blanks to be fed, (b) means for raising the platform to maintain the top of the supported stack at about a predetermined height, (c) a stationary head located above the platform and stack and provided with inlet openings connected to a negative pressure source for sucking a blank into contact with the head, and (d) a reciprocating suction box provided in the head and having its surface substantially co-planar with the surface provided with the stationary inlet openings, for feeding the blanks onwards the mechanism being provided with additional means for transferring blanks one by one in the onward feed direction when the rear of the stacks is in use.

2. Mechanism as claimed in claim 1 wherein the additional transferring means comprises at least one endless belt extending over the position of the forward stack and arranged to engage blanks being fed from the rearward stack and transfer them to the reciprocating suction box associated with the forwards stack.

* * * * *

UNITED STATES PATENT OFFICE
CERTIFICATE OF CORRECTION

PATENT NO. : 4,211,398

DATED : July 8, 1980

INVENTOR(S) : Thomas Desmond Bishop

It is certified that error appears in the above-identified patent and that said Letters Patent are hereby corrected as shown below:

Column 4, Line 15-16 - "the use alternately" should be -be used alternately-

Signed and Sealed this

*Eighteenth* Day of *August 1981*

[SEAL]

*Attest:*

GERALD J. MOSSINGHOFF

*Attesting Officer*

*Commissioner of Patents and Trademarks*